United States Patent [19]

Shida et al.

[11] 3,938,360

[45] Feb. 17, 1976

[54] SHAPE CONTROL METHOD AND SYSTEM FOR A ROLLING MILL

[75] Inventors: Shigeru Shida; Kenichi Yasuda; Hiroshi Awazuhara, all of Hitachi; Sukebumi Tsumura, Mito, all of Japan

[73] Assignee: Hitachi, Ltd., Japan

[22] Filed: Apr. 30, 1974

[21] Appl. No.: 465,577

[30] Foreign Application Priority Data

May 2, 1973 Japan ..... 48-48509
Nov. 21, 1973 Japan ..... 48-130232

[52] U.S. Cl. ..... 72/8; 72/21
[51] Int. Cl.² ..... B21B 37/08
[58] Field of Search ..... 72/6–9, 21, 72/19,

[56] References Cited

UNITED STATES PATENTS

| | | | |
|---|---|---|---|
| 3,387,470 | 6/1968 | Smith, Jr. | 72/7 |
| 3,531,960 | 10/1970 | Stone | 72/8 |
| 3,714,805 | 2/1973 | Stone | 72/8 |
| 3,803,886 | 4/1974 | Sterrett et al. | 72/8 |

*Primary Examiner*—Milton S. Mehr
*Attorney, Agent, or Firm*—Craig & Antonelli

[57] ABSTRACT

A shape control system for a rolling mill comprises means for operating a roll positioning means to press down the rolls under a preselected load, when no strip to be rolled is fed between the rolls; a calculator of roll position variation for comparing the roll position under the preselected load with a preselected reference roll position; a calculator of roll crown variation for calculating the roll crown variation by using the output from said calculator of roll position variation and a preselected functional relationship; and a calculator of roll bending force for calculating the amount of a roll bending force to be corrected based on the output from said calculator of roll crown variation and feeding the thus calculated correction to roll bender control means.

11 Claims, 3 Drawing Figures

SHAPE CONTROL METHOD AND SYSTEM FOR A ROLLING MILL

BACKGROUND OF THE INVENTION

This invention relates to a method and system for controlling flatness in sheet metal by detecting the variation in the roll crown.

Recently, there has arisen an increasingly demand for the accuracy in the thickness of a cold rolled strip. With the development of an automatic gauge control means (AGC), a satisfactory uniformity in gauge of a strip can be attained in the rolling direction. However, no satisfactory control method has been realized for achieving an accuracy in gauge of a strip in the widthwise direction and, especially, the flatness of the strip. A known method for controlling the flatness of a strip (or shape control) is a roll bending method, wherein the variation in the roll crown due to wear and/or thermal expansion (heat crown) of rolls (the latter is caused by the heat radiation from the strip being rolled as well as by the heat caused by the deformation of a strip) must be compensated for to control the flatness of a strip. This control method, however, is no longer employed widely, because difficulties are encountered in determining the extent of the roll crown varied due to wear and heat and therefore a roll bending force cannot be set beforehand.

SUMMARY OF THE INVENTION

It is therefore a primary object of this invention to provide a method for controlling flatness of a strip in a rolling mill, by detecting the roll crown variation.

According to this method, the correlation between variations of the roll crown and of the roll position under a preselected rolling load is determined beforehand; then the roll crown variation is measured during operation, as required; and the shape control means is controlled depending on the thus measured roll position variation and the predetermined correlation between variations of the roll crown and of roll position.

In other words, the control method of this invention is based on the finding that there is a linear proportional relation between the roll crown variation $\Delta C_R$ during the repeated rolling operations and the variation of roll position $\Delta S_o$ under a preselected rolling load. Based on said linear proportional relation, the roll crown variation $\Delta C_R$ is determined indirectly from the variation of roll position $\Delta S_o$ for controlling the shape control means such as a roll bending means.

The present invention provides suitable shape control systems for practicing the aforesaid method.

DESCRIPTION OF THE PREFERRED EMBODIMENT

Figure 1:
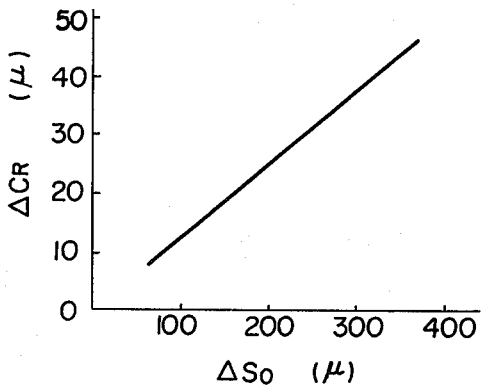
FIG. 1 is a graph representing the relationship between the indication variation $\Delta S_o$ (or the variation of roll position under a preselected rolling load) at the time when the roll gap equals to zero and the roll crown variation $\Delta C_R$.

Before describing preferred embodiments, the theoretical explanation for the control method according to this invention will first be set forth hereinunder.

Generally, when rolling a strip, an irregular thickness distribution takes place widthwise of the strip, with there resulting a strip crown. Such a strip crown $C_S$ is expressed by the following relation:

$$C_S = C_R + C_1 \quad (1)$$

where, $C_R$ is a roll crown and $C_1$ is a crown formed in a rolled strip due to the causes other than the roll crown. The crown $C_1$ includes a crown $C_2$ intentionally formed in the strip by means of a roll bender and a crown $C_3$ caused in the strip under a rolling load.

$$C_1 = C_2 + C_3 \quad (2)$$

These crowns $C_2$ and $C_3$ are discussed, for example, in the "Iron and Steel Engineer" Vol. 42, No. 8, 1965, p. 73 –83 by Stone. According to Stone's discussion, when a back roll bending is applied, the crown $C_2$ will be expressed as, $$C_2 = -\frac{F \cdot a \cdot W^2}{4E \cdot I} \quad (3)$$

where, $F$ is a roll bending force; $a$ is a moment arm of the bending force; $W$ is the strip width; $E$ is the Young's modulus of the roll and $I$ is the moment of inertia of the backup roll. If $4E/aW^2$ is substituted by $K_1$, then the Equation (3) will be simplified as follows:

$$C_2 = -\frac{F}{K_1} \quad (4)$$

This relation is maintained also in case of a work roll bending, although $K_1$ has a different value.

According to Stone's discussion, $C_3$ is expressed as $$C_3 = \frac{5PW^3}{192EI} \quad 1 + \frac{24}{5} \quad \left(\frac{h}{W}\right) + 2 \quad \left(\frac{D}{W}\right)^2 \quad (5)$$

where, $P$ is a rolling load; $h$ is a distance from the side edge of the strip to the center of the backup roll bearing; and D is a diameter of the backup roll.

It will be appreciated that Equation (1) can be rewritten as follows:

$$C_S = C_R - \frac{F}{K_1} + C_3 \quad (6)$$

Also Equation (6) will be rewritten as follows:

$$\Delta C_S = \Delta C_R - \frac{\Delta F}{K_1} + \Delta C_3 \quad (7)$$

where $\Delta$ means mathematical symbol of variation. To obtain a flat rolled strip, $\Delta C_S$ must be zero. Therefore, $$\Delta F = K_1 (\Delta C_R + \Delta C_3) \quad (8)$$

If roll bending force which offsets roll crown variation $\Delta C_R$ is denoted by $\Delta F_R$, $\Delta F_R$ is expressed as follows:

$$\Delta F_R = K_1 \Delta C_R \quad (9)$$

The study made by the inventors reveals that variation $\Delta S_o$ in indicated value of roll position under a preselected rolling load at the time when the roll gap equals to zero is directly proportional to the roll crown variation $\Delta C_R$ as shown in FIG. 1.

$\Delta C_R = K_2 \Delta S_o$ (10) where $K_2$ is a constant value represented by the slope of the line in FIG. 1. From Equations (9) and (10), $\Delta F_R = K \Delta S_o$ (11)

where, $K = K_1 \cdot K_2$. Equation (11) means that the roll bending force which offsets the roll crown variation is directly proportional to the variation $\Delta S_o$, and therefore a roll bending force offsetting the roll crown variation can be determined by detecting the variation $\Delta S_o$ in indicated value.

Figure 2:
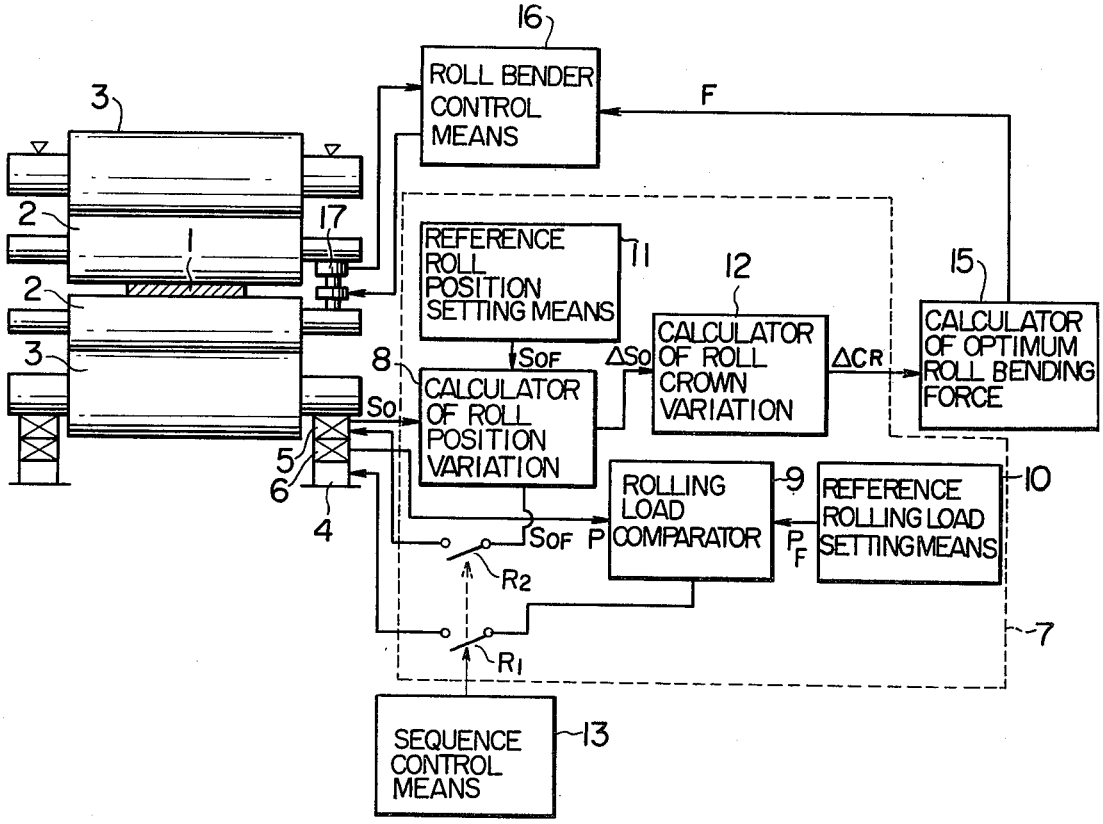
FIG. 2 is a block diagram of the shape control system for a rolling mill according to one embodiment of this invention.

Illustrated in FIG. 2 is a schematic view illustrating the arrangement of the shape control system according to one embodiment of the present invention, the system detecting a roll crown variation and controlling, in accordance with the foregoing principle, the shape of the strip being rolled. Indicated at 1, 2 and 3 are a steel strip being rolled, work rolls and backup rolls, respectively. Between the roll neck of the lower backup roll 3 and roll positioning means 4 are interposed a roll position detector 5 and a load detector 6, which are respectively connected to a calculator of roll position variation 8 and to a rolling load comparator 9 included in a roll crown variation detector 7 for feeding inputs into the detector 7 which forms the essential part of the present inventon.

The roll crown variation detector 7 comprises reference load setting means 10, load comparator 9, reference roll position setting means 11, calculator of roll position variation 8, calculator of roll crown variation 12, relay $R_1$ for applying the output signal from said load comparator 9 into the roll positioning means 4, and relay $R_2$ for operating indicator of the roll position detector 5. The relays $R_1$ and $R_2$ are so arranged that they are closed upon receiving sequence signals from an external sequence control means 13 (for example, a computer).

Now the operation of the roll crown variation detector 7 having the foregoing construction will be described in connection with a cold rolling mill. After a predetermined number of coils have been rolled, an instruction signal for detecting the roll crown variation is produced from the sequence control means 13 to be fed to the roll crown variation detector 7. As a result, the relay $R_1$ (which is arranged on the output line from the load comparator 9 adapted to compare the reference load signal $P_F$ from the reference load setting means 10 with the output signal $P$ from the load detector 6) is closed to thereby feed the output from the load comparator 9 to the roll positioning means 4. Then, the roll positioning means 4 starts operating and continues to work until a condition of $P = P_F$ is reached. Simultaneous therewith, the roll positioning means 4 stops operating, the roll position detector 5 starts operating to feed the roll position $S_o$ under a load $P_F$ to the calculator of roll position variation 8. The calculator 8 then calculates a difference $\Delta S_o$ between the input signal $S_{oF}$ from the reference roll position setting means 11 and the input signal $S_o$ from the roll position detector 5 for feeding the difference $\Delta S_o$ to the calculator of roll crown variation 12. By use of this input $\Delta S_o$, the calculator of roll crown variation 12 calculates the above-mentioned relation $\Delta C_R = K_2 \Delta S_o$ and produces an output $\Delta C_R$. Relay $R_2$ is closed by an instruction signal of the sequence control means 13 for changing $S_o$ to $S_{oF}$ if necessary.

With the foregoing arrangement, the roll crown variation can be detected automatically without dismounting a roll from the rolling mill. The detected roll crown variation is then fed to a shape control means as will be described later, for thereby effecting the calculation for shape control, that is, a calculation for determining the optimum roll bending. The shape control means of the present invention includes roll crown variation detector 7, the calculator of optimum roll bending force 15 operative in response to the output from said detector 7, and roll bender control means 16 operative in response to the output from said calculator 15 to control a roll bender 17. The calculator of optimum roll bending force 15 calculates the optimum roll bending force $F$. From Equation (6), force $F$ will be expressed as follows:

$F = K_1 (C_R + C_3 - C_S)$ (12)

This is a formula for obtaining the optimum roll bending force $F$ to produce a strip having a predetermined crown $C_S$.

By introducing the roll crown value $C_R$ obtained after the preceding rolling operation, Equation (12) will be changed as follows:

$F = K_1 (C_R + \Delta C_R + C_3 - C_S)$ (13)

It will be understood from this Formula (13) that the optimum roll bending force $F$ can be obtained only by detecting the roll crown variation $\Delta C_R$.

As has been described hereinabove, this invention permits a shape control calculation by detecting the roll crown variation, which has not been detectable heretofore. The shape control calculation makes possible to effect a roll bender control by use of a computer, thereby greatly contributing to improve the quality of a strip by eliminating a danger that the strip of inferior shape is produced.

Figure 3:
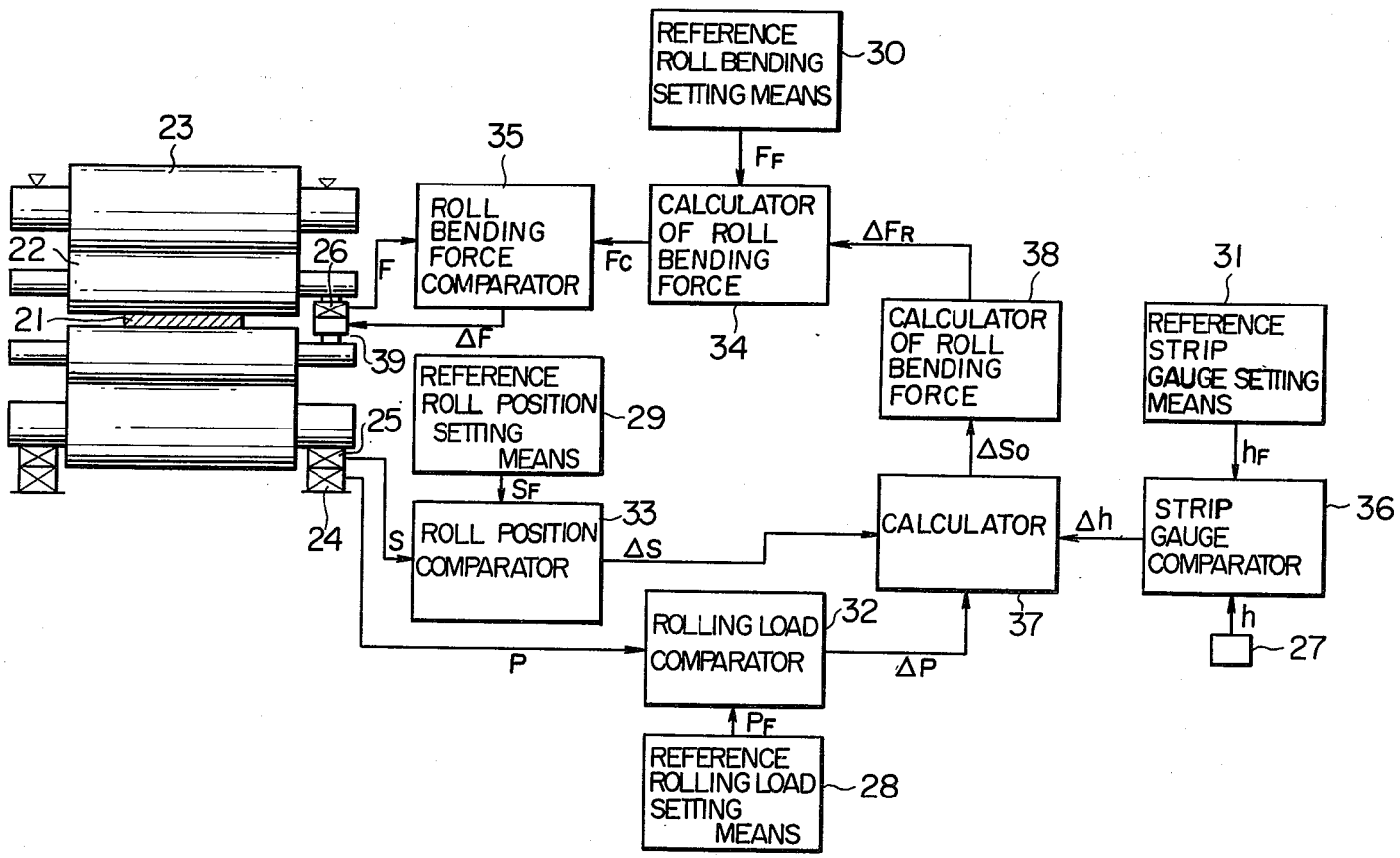
FIG. 3 is a block diagram of the shape control system for a rolling mill according to another embodiment of this invention.

Although the invention has been described hereinabove with reference to an embodiment wherein the roll crown variation is measured depending on the detected roll position variation at the zero adjustment which is effected before rolling, it is also possible to correct the roll crown variation during rolling by use of an automatic gauge control system (AGC) as in the second embodiment of FIG. 3. According to this second embodiment the rolling mill is provided with work rolls 22 and backup rolls 23 for rolling a strip 21. The rolling load $P_F$, roll position $S_F$, bending force $F_F$ and a gauge $h_F$ of a strip are set by reference value setting means 28, 29, 30 and 31, respectively. The detected load $P$ from a rolling load detector 24 and the reference rolling load $P_F$ from the reference rolling load setting means 28 are fed to a comparator 32 to determine their difference $\Delta P$, which is then fed to calculator 37. The detected roll position S from a roll position detector 25 and the reference roll position $S_F$ from the reference roll position setting means 29 are fed to a comparator 33 to determine their difference $\Delta S$, which is then fed to the calculator 37. Similarly, the detected strip gauge $h$ from a strip gauge detector 27 and the reference strip gauge $h_F$ from the reference strip gauge setting means 31 are fed to a comparator 36 to determine their difference $\Delta h$, which is then fed to the calculator 37. By use of these inputs $\Delta P$, $\Delta S$ and $\Delta h$, the calculator 37 performs a calculation in accordance with the following automatic gauge control formula to thereby feed a value $\Delta S_o$ to calculator 38.

$$\Delta S_o = \Delta S - \Delta h + \frac{\Delta P}{Km} \qquad (14)$$

where, Km is a mill modulus. $\Delta S_o$ corresponds to variation of roll position at the time when roll gap and rolling load equal to zero. In accordance with formula (11), the calculator 38 calculates $\Delta F_R$ and feeds the same to a calculator 34. The calculator 34 adds the output $F_F$ from the reference roll bending force setting means 30 to the calculated $\Delta F_R$ to obtain a sum $F_C$ and then feeds the sum $F_C$ to a comparator 35, which in turn calculates the difference $\Delta F$ between said sum $F_C$ and the output F from the roll bending force detector 26, for thereby operating a roll bending force control means 39 in response to the calculated difference $\Delta F$. It will be appreciated that, with this embodiment, the variation in the roll bending force with respect to the variation in the roll crown, of which automatic control has been unattainable heretofore, can be corrected continuously.

What is claimed is:

1. A shape control system for use with a rolling mill, the system comprising means for detecting the rolling load and roll position, means for determining the variation roll position $\Delta S_o$ from the detected rolling load and roll position; means for calculating the roll crown variation $\Delta C_R$ from said variation $\Delta S_o$ in accordance with a preselected functional relation; and means for controlling the roll bending means in response to the output from means for said calculator.

2. A shape control system for use with a rolling mill, the system comprising means for operating roll positioning means to press down the rolls under a predetermined load when the roll gap equals to zero; a calculator means of roll position variation for comparing the position of the rolls at the time when the rolls are pressed down under said predetermined load with a preselected reference roll position for providing a roll position variation signal; a calculator means of roll crown variation for calculating the roll crown variation from said roll position variation signal in accordance with a preselected functional relation; and calculator means of roll bending force for calculating the amount of the roll bending force correction from the output from said calculator means of roll crown variation and feeding the amount of the roll bending force corrected to a roll bender control means.

3. A shape control system for use with a rolling mill, the system comprising first means for detecting the rolling load; second means for detecting a roll position during rolling; third means for detecting the strip gauge on the outlet side; fourth means for detecting the roll bending force of the roll bender; calculator means for calculating the amount of the roll bending force which would correct for the roll crown variation calculated from the values detected by said first, second, third and fourth means in accordance with a preselected functional relation; and means for correcting the roll bending force depending on the value calculated by said calculator means.

4. A shape control system according to claim 1, wherein the means for calculating calculates $\Delta C_R$ in accordance with the functional relation $\Delta C_R = K_2\ \Delta S_o$ where $K_2$ is a constant.

5. A shape control method for use in a rolling mill comprising the steps of determining a variation of roll position $\Delta S_o$ corresponding to a time when the roll gap is zero and under preselected rolling load, and converting the variation $\Delta S_o$ into a roll crown variation $\Delta C_R$ in accordance with a predetermined functional relation for thereby controlling a shape control means in dependence on the roll crown variation $\Delta C_R$.

6. A shape control method for use in a rolling mill according to claim 5, further comprising the step of controlling the shape control means in dependence on the roll crown variation $\Delta C_R$.

7. A shape control method for use in a rolling mill according to claim 5, wherein the predetermined functional relation is $\Delta C_R = K_2\ \Delta S_o$ wherein $K_2$ is a constant.

8. A shape control method for use in a rolling mill according to claim 5, wherein the step of determining a variation of roll position $\Delta S_o$ includes measuring the roll position under a preselected rolling load with the roll gap set to zero and comparing the measured roll position with a preselected reference roll position to determine the variation of roll position $\Delta S_o$.

9. A shape control method for use in a rolling mill according to claim 5, wherein the step of determining a variation of roll position $\Delta S_o$ includes measuring the roll position, rolling load and strip gauge, comparing the measured roll position, rolling load and strip gauge with corresponding preset reference values to determine the variation from the preset reference values, and obtaining the variation $\Delta S_o$ from the variations.

10. A shape control method for use in a rolling mill according to claim 9, wherein the variation in roll position is $\Delta S$, the variation in rolling load is $\Delta P$, and the variation in strip gauge is $\Delta h$, and the variation $\Delta So$ is obtained in accordance with $\Delta S_o = \Delta S - \Delta h + \Delta P/Km$ where Km is a mill modulus.

11. A shape control method for use in a rolling mill according to claim 5, wherein a roll bending means is used as the shape control means, and further comprising the step of correcting the optimum roll bending force of the roll bending means in response to the variation $\Delta S_o$.

* * * * *